United States Patent [19]

Schmidt

[11] Patent Number: 4,600,211

[45] Date of Patent: Jul. 15, 1986

[54] SECTIONED SKI

[76] Inventor: Glenn H. Schmidt, 1857 Los Encinos, Glendale, Calif. 91208

[21] Appl. No.: 544,537

[22] Filed: Oct. 24, 1983

Related U.S. Application Data

[62] Division of Ser. No. 292,787, Aug. 14, 1981, abandoned.

[51] Int. Cl.[4] ..... A63C 5/02

[52] U.S. Cl. ..... 280/603; 403/339

[58] Field of Search ..... 280/601, 603; 403/334, 403/339, 340, 393

[56] References Cited

U.S. PATENT DOCUMENTS

| | | | |
|---|---|---|---|
| 581,917 | 5/1897 | Munz | 403/339 X |
| 594,043 | 11/1897 | Thompson et al. | 403/339 |
| 599,717 | 3/1898 | Maddux | 403/339 X |
| 1,170,429 | 2/1916 | Dunlap | 403/339 X |
| 1,655,766 | 1/1928 | Hildebrant | 403/340 |
| 2,277,281 | 3/1942 | Vinton | 280/603 |
| 2,893,521 | 7/1959 | Austin | 403/340 X |
| 3,596,918 | 8/1971 | Masuda | 280/603 |
| 3,797,838 | 3/1974 | Shurgot et al. | 280/603 |
| 3,819,198 | 6/1974 | Groves | 280/603 |

*Primary Examiner*—Joseph F. Peters, Jr.
*Assistant Examiner*—Michael Mar
*Attorney, Agent, or Firm*—William W. Haefliger

[57] ABSTRACT

A ski includes at least two sections interconnectible end-to-end, one section having a recess sunk in an end portion thereof and the other ski section having a tongue projecting from an end portion thereof, the recess and tongue shaped to closely interfit when the ski sections are assembled, end-to-end, thereby to provide a full length ski, there being structure to positively and releasably interconnect said end portions in assembled condition.

4 Claims, 22 Drawing Figures

SECTIONED SKI

This is a division of application Ser. No. 292,787, filed Aug. 14, 1981 now abandoned.

BACKGROUND OF THE INVENTION

This invention relates generally to ski equipment, and more particularly to a ski and pole constructions capable of being quickly broken into sections for ease of transport, the sections being readily re-assembled for use.

It is a known fact that skis and poles are cumbersome to carry or transport, either by hand or on vehicles. Accordingly, there has long been a need to overcome the cumbersome problem. While various ways of providing interconnectable ski sections have been proposed, as in U.S. Pat. Nos. 382,254, 2,198,361, 3,104,888, 3,439,928 and 3,884,315, none to my knowledge embodies the unusually advantageous simplicity of structure, and ease of disassembly and re-assembly as well as other features as now embodied in the present ski construction.

SUMMARY OF THE INVENTION

It is a major object of the invention to provide an improved ski construction overcoming prior problems and meeting the above need. Basically, the ski comprises:

(a) at least two ski sections interconnectable end-to-end, (b) one ski section having a recess sunk in an end portion thereof and the other ski section having a tongue projecting from an end portion thereof, the recess and tongue shaped to closely interfit when the ski sections are assembled, end-to-end, thereby to provide a full length ski, (c) and means to positively and releasably interconnect said end portions in assembled condition.

As will appear, the tongue and recess (or groove) have wedge interfit, as for example in directions endwise, lateral to, or perpendicular to the ski top surface length dimension; and interengageable stop shoulders are provided on the sections to strengthen the assembled ski as against bending during use. Further, the interconnection means typically comprise a fastener, or fasteners, that extend between the sections near the tongue and recess (and typically intersect same), the fasteners characterized as easily removable and reinsertable. In addition, the ski binding plate may overlap the joint between the sections to assist in positive fastening.

Additional objects include providing ski pole sections interconnectible via tongue and groove parts, as will be seen; and the provision of an easily transported carrier for disconnected ski and ski pole sections.

These and other objects and advantages of the invention, as well as the details of an illustrative embodiment, will be more fully undestood from the following description and drawings, in which:

DRAWING DESCRIPTION

DETAILED DESCRIPTION

Referring first to FIGS. 1, 2 and 4–6, a ski 10 includes two sections 10*a* ad 10*b*, the joint therebetween indicated generally at 11. That joint is typically located at about the mid position, endwise, of the ski, so that each of the sections is about ½ the ski overall length. This greatly facilitates carriage or transport of the two sections in side-by-side relation, for example.

One ski section has a recess sunk in an end portion of same, and the other ski section has a tongue projecting from an end portion thereof. The recess and tongue are shaped to closely interfit when the sections are assembled, end-to-end, to provide the full length ski of bending strength substantially equivalent to the bending strength of the same ski with unbroken construction.

Figure 3:
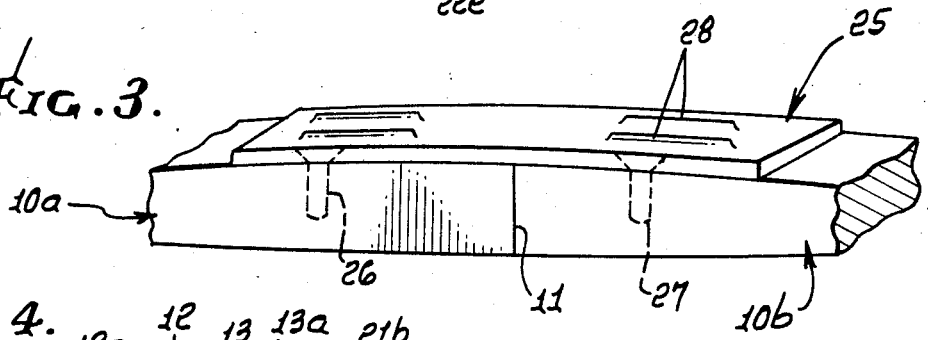
FIG. 3 is a perspective view of a ski joint as in FIGS. 1 and 2, with a binding plate removably interconnecting the two sections.
Figure 4:
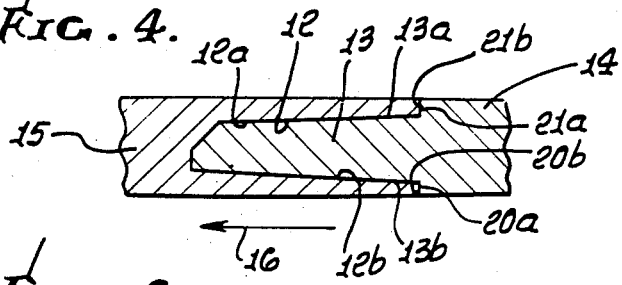
FIG. 4 is a section taken on lines 4—4 of FIG. 1.
Figure 5:
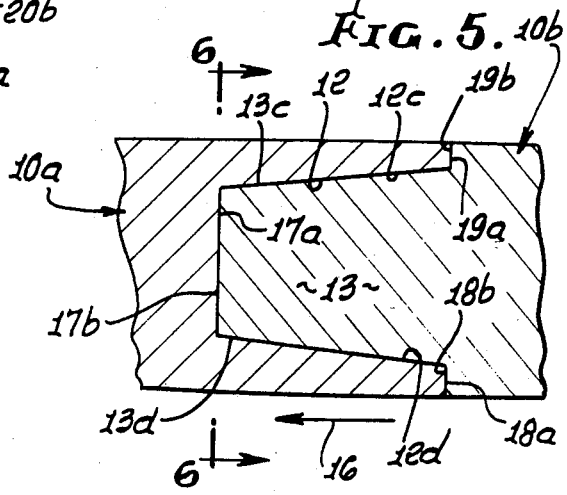
FIG. 5 is a section taken on lines 5—5 of FIG. 2.
Figure 6:
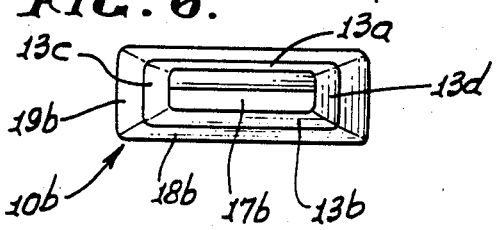
FIG. 6 is a section taken on lines 6—6 of FIG. 5.

In the example, the recess and tongue are indicated at 12 and 13 as respectively associated with ski end portions 14 and 15, in FIGS. 4 and 5. The illustrated recess has upper and lower interior walls 12*a* and 12*b* which taper in the interfit direction indicated by arrow 16; and the tongue has upper and lower exterior walls 13*a* and 13*b* which taper in direction 16 to engage with 12*a* and 12*b* on make-up. Also, the recess has opposite side walls 12*c* and 12*d* which taper in direction 16, and the tongue likewise has opposite side walls 13*c* and 13*d* which taper in direction 16 to engage recess walls 12*c* and 12*d* upon make-up. Interengageable stop shoulders to limit make-up are indicated at 17*a* and 17*b*, 18*a* and 18*b*, 19*a* and 19*b*, 20*a* and 20*b*, and 21*a* and 21*b*, in FIGS. 4–6. Shoulders 18a–21a are on ski-section 10b, and surround the tongue at its base. Also, shoulders 18a–21a define the junction line 11, seen in FIGS. 1–3. Interengaged shoulders 20a and 20b and 21a and 21b aid in resisting relative up and down bending of the ski sections, at joint 11, the interengaged tongue and recess walls also resisting such relative bending.

Figure 1:
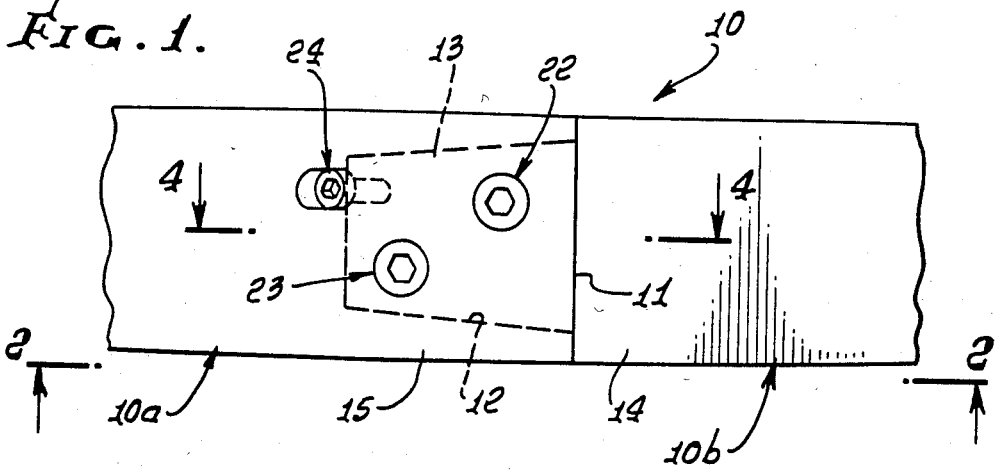
FIG. 1 is a plan view of a ski section joint embodying the invention.
Figure 2:
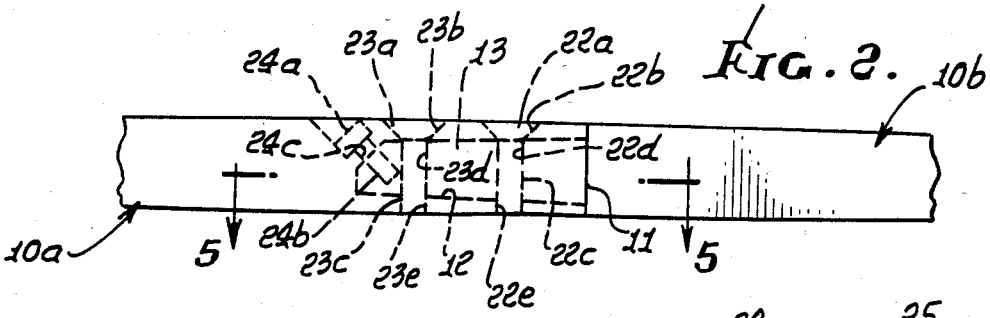
FIG. 2 is a side view taken on lines 2—2 of the FIG. 1.

Also provided is means to positively and releasably interconnect the ski sections at the locus of the tongue and recess. As illustrated, three fasteners are provided at 22–24. Fasteners 22 and 23 have tapered heads 22a and 23a received against tapered seats 22b and 23b in the portion of ski section 10a; also the fastener shanks 22c and 23c pass downwardly through openings 22d and 23d in the tongue, and then have threaded interfit with the lower portion of the ski section 10a, at loci 22e and 23e, all of which is seen in FIG. 2. Such fasteners may have hex-openings as shown in their heads, to facilitate quick insertion and tightening of the fasteners, as well as removal, by the skier. Fastener 24 extends obliquely downwardly and endwise (relative to the ski sections), and has a head 24a on an internal shoulder in the section 10a, and a threaded shank 24b, into a threaded bore 24c in the end of tongue 14.

In FIG. 3, a ski binding plate 25 is shown as overlapping the two sections 10a and 10b, i.e. across joint 11, and as removably connected thereto, as via fasteners 26 and 27. The latter have heads that seat in tapered openings in the plate, and shanks that pass downwardly into threaded openings in the ski sections, endwise beyond the tongue and groove loci. On the top of plate 25 are ridges 28 that interengage similar ridges on a skier's boot.

Figure 7:
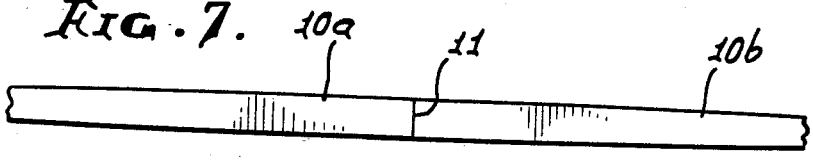
FIG. 7 is a side view of a portion of an all metal ski embodying the invention of FIGS. 1–6, and showing the external appearance of the joint between the ski sections.
Figure 8:
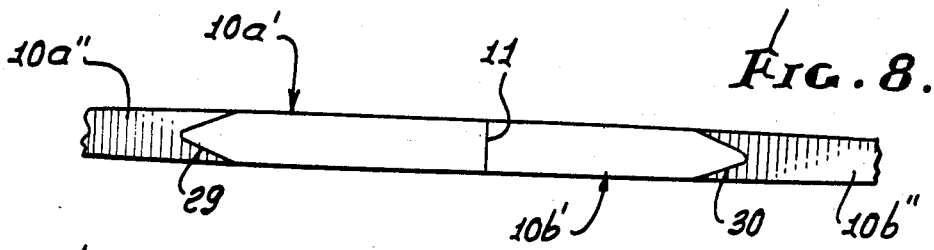
FIG. 8 is a view like FIG. 7, but showing ski sections each consisting of metal connected with molded glass fiber portion.

FIG. 7 shows a greater length of ski 10, and in all-metal form. In FIG. 8, the ski sections 10a and 10b are constructed of metal portions 10a' and 10b', and molded glass-fiber portions 10a'' and 10b''. Portions 10a' and 10a'' are integrally interconnected at endwise V-tapered joint 29, as shown; and portions 10b' and 10b'' are likewise integrally interconnected at endwise V-tapered joint 30.

Figure 9:
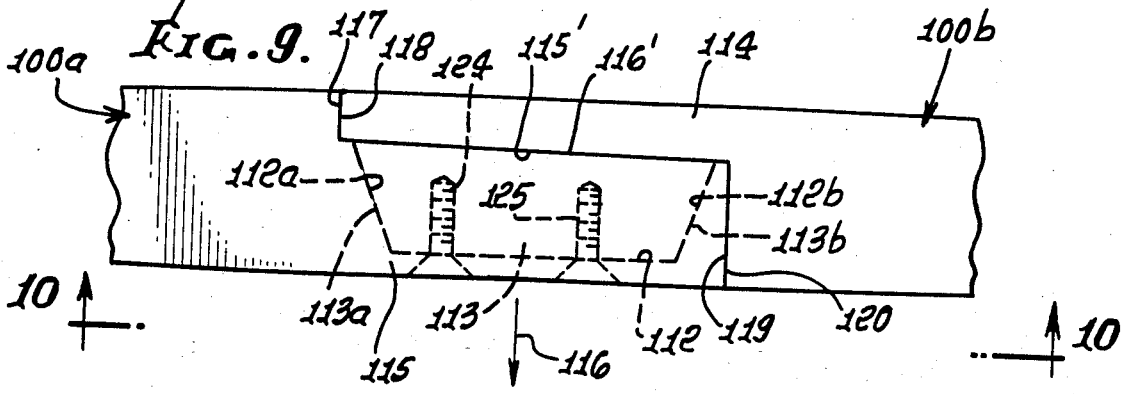
FIG. 9 is a plan view like FIG. 1 showing an alternate construction.

Referring now to FIG. 9, the ski sections 100a and 100b correspond in general to sections 10a and 10b above. Tongue 113 integral with end portion 114 of section 100b wedgably interfits recess 112 formed in the end portion 115 of section 100a. The interfit is lateral of the ski lengthwise dimension, i.e. direction indicated by arrow 116. Note the tongue end wall taper at 113a and 113b, and corresponding recess end wall taper at 112a and 112b. Tapers 112a and 113a interengage on make-up, as do tapers 112b and 113b. Longitudinal stop shoulders 115' and 116' on the portions 114 and 115 interengage on lateral make-up, and lateral stop shoulders 117 and 118, and 119 and 120 also interengage on make-up. Interconnection fasteners 124 and 125 extend laterally, as shown, to releasably interconnect the sections at the tongue and recess locus.

Figure 10:
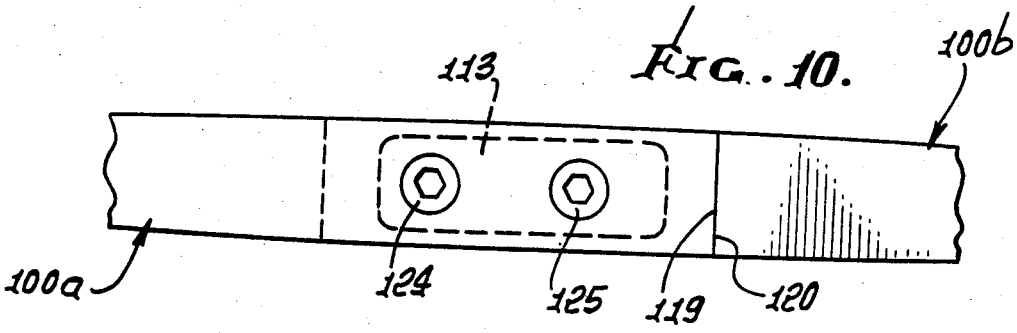
FIG. 10 is a side view, in elevation, taken on lines 10—10 of FIG. 9.
Figure 11:
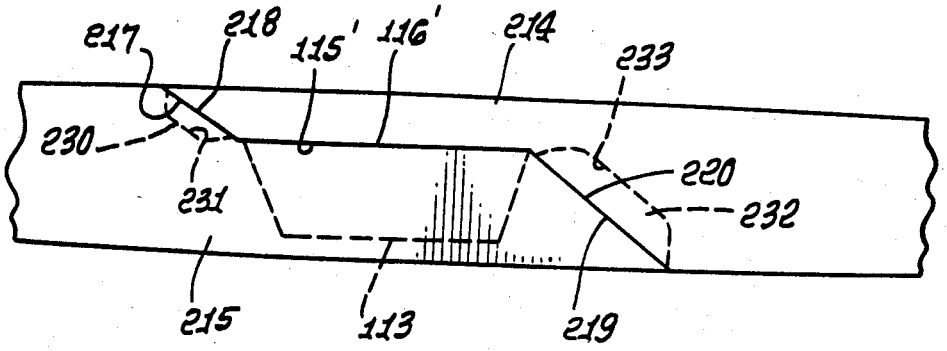
FIG. 11 is a top plan view like FIG. 7, but showing another alternative construction.

In FIG. 11, the construction is like that in FIGS. 9 and 10, except that stop shoulders 217 and 218 (corresponding to 117 and 118 in FIG. 9) and stop shoulders 219 and 220 (correspondong to 119 and 220) are angled or beveled, as shown. Also, a smaller tongue 230 on section 214 interfits a recess 231 on section 215, adjacent shoulders 217 and 218; and, a smaller tongue 232 on section 215 interfits a recess 233 on section 214, adjacent shoulders 219 and 220.

Figure 12:
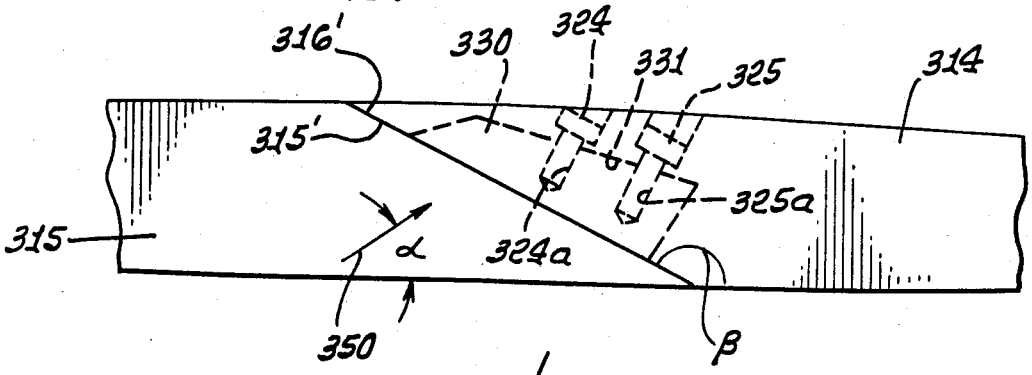
FIG. 12 is a top plan view like FIG. 7, but showing a further and alternative construction.

In FIG. 12, the construction is again similar to that of FIGS. 9 and 10, except that the tongue 330 on section 315 extends in direction 350 into the recess 331 in section 314 with wedging interfit. Direction 350, indicated by an arrow, is at an angle $\alpha$ relative to the ski lengthwise direction. Angle $\alpha$ is less than 90° and is between about 25° and 65°. Fasteners 324 and 325 extend from recesses in section 314 into threaded openings 324a and 325a in the tongue. Stop shoulders 315' and 316' on the sections define a plane which extends at an angle $\beta$ relative to the ski lengthwise direction. Angle $\beta$ is between 90° and 180° and is typically between about 135° and 160°.

Figure 13:
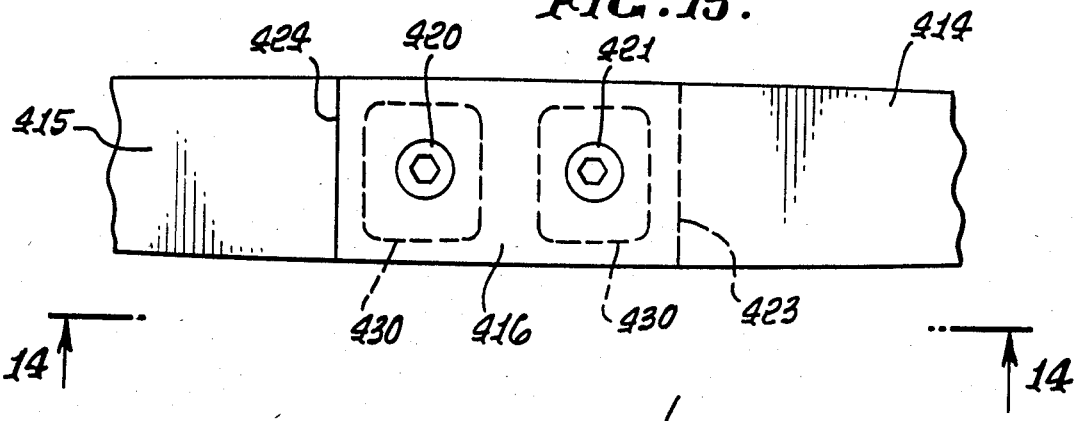
FIG. 13 is a top plan view of a further modified ski construction.
Figure 14:
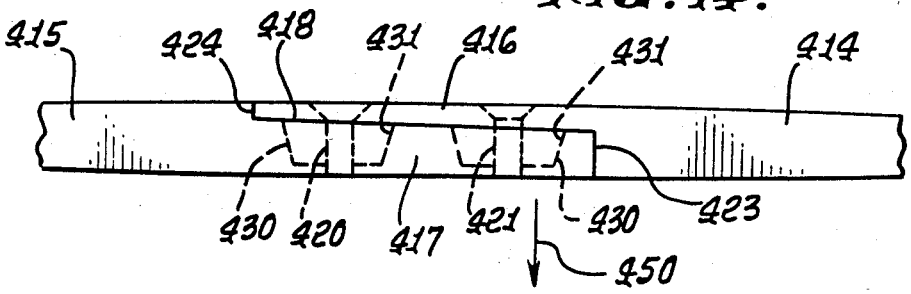
FIG. 14 is a side view taken on lines 14—14 of FIG. 13.

In FIGS. 13 and 14 the two tongues 430 on section 414 extend in direction 450 into recesses 431 in section 415, with wedging interfit. Direction 450 indicated by the arrow is perpendicular to the flat plane of the ski top surface. Ski portions 416 and 417 have overlapping-underlapping relationship as shown, and define an interengagement plane 418. Fasteners 420 and 421 have heads received in portion 416 and shanks threadably received in portion 417 to positively interconnect the sections. Stop shoulders appear at the ends of portions 416 and 417, a locations 423 and 424.

Figure 15:
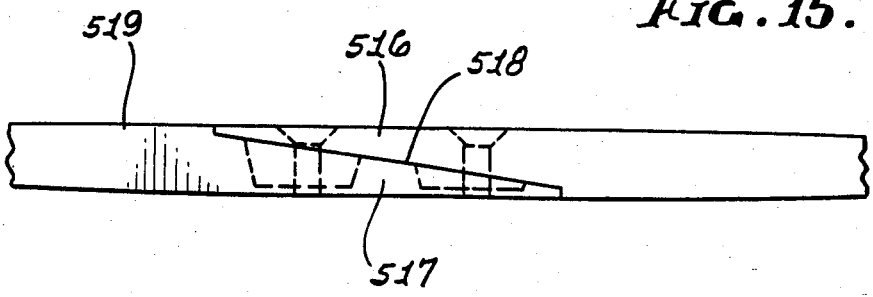
FIG. 15 is a side view like FIG. 14, but showing a modification.

In FIG. 15 the construction is again like that in FIGS. 13 and 14, except that the ski portions 516 and 517 that have overlapping-underlapping relationship define an interengagement plane 518 that is tilted relative to the plane of the ski top surface 519.

Figure 16:
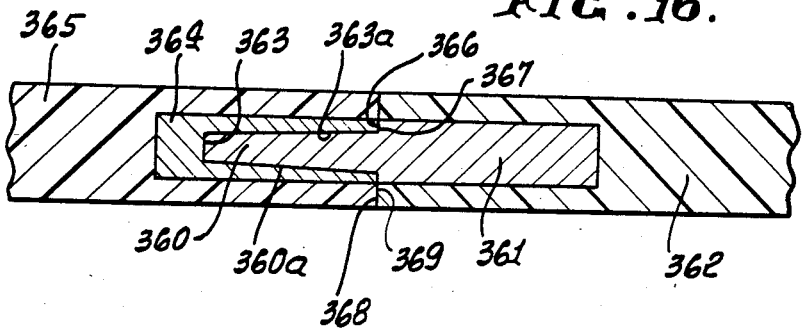
FIG. 16 is a view like FIG. 8, showing a somewhat different fabrication technique.

In FIG. 16, the endwise tapered tongue 360 integral with end portion 361 of ski section 362 wedgably interfits endwise tapered recess 363 formed in the end portion 364 of ski section 365. The tapers 360a and 363a interengage on make-up, as do abutting stop shoulders 366 and 367. Also, stop shoulders 368 and 369 on the surrounding glass fiber ski sections interengaged on make-up, and align with shoulders 366 and 367 to form a single joint. Portions 361 and 364 are metallic inslits in the surrounding glass fiber body material.

Figure 17:
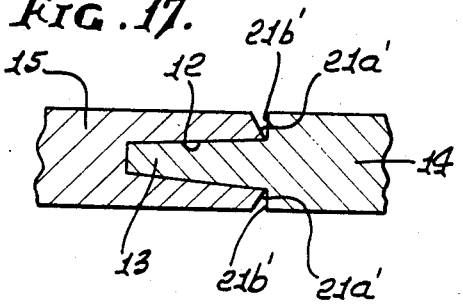
FIG. 17 is a view like FIG. 4.

FIG. 17 is a view like FIG. 4, and bears the same numbers except for end shoulders 21a' and 21b' (corresponding to shoulders 21a and 21b in FIG. 4). Shoulders 21a' and 21b' diverge in directions away from the tongue 13, to provide relief, permitting greater joint, bending flexibility, vertically. The angle of divergence (relief angle) may be less than about 5° to permit ultimate interengagement of the shoulders to limit bending.

Figure 18:
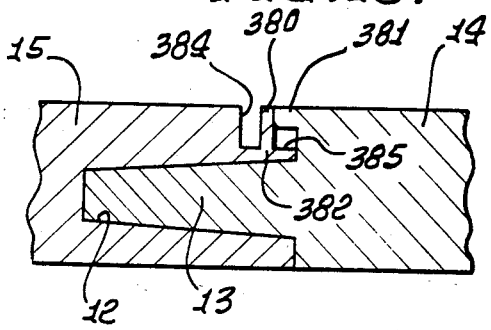
FIG. 18 is another view like FIG. 4.

FIG. 18 is again like FIG. 4, and also FIG. 17, except that a bending flange 380 integral with ski end portion 15 resiliently resists upward deflection of end portion 14. A horizontally projection 381 on section 14 engages vertical flange 380, as shown, above its juncture 382 with section 15, to forcibly urge it to the left, as section 14 flexes upwardly. Note notches 384 and 385 in end portion 15, and opposite sides of flanges 380.

Figure 19:
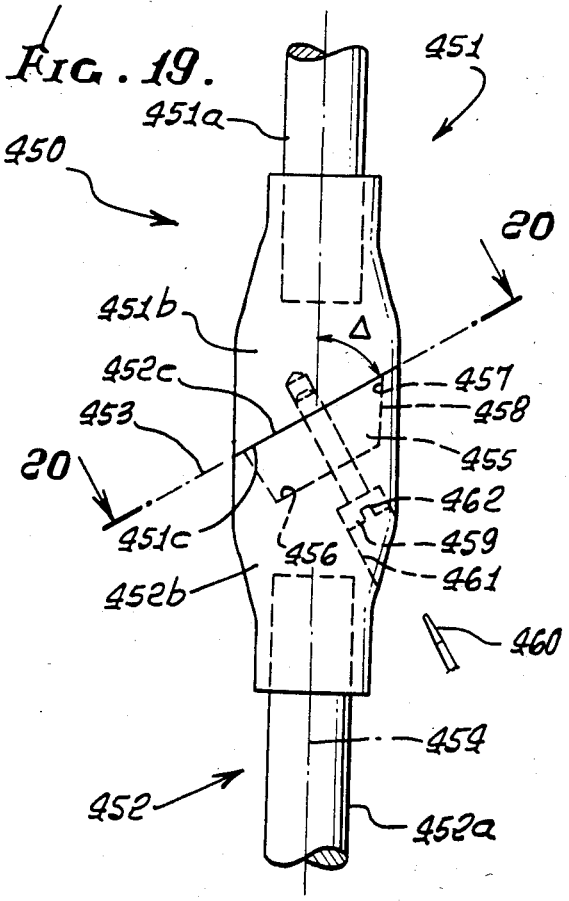
FIG. 19 is an elevation showing a ski pole joint embodying the invention.
Figure 20:
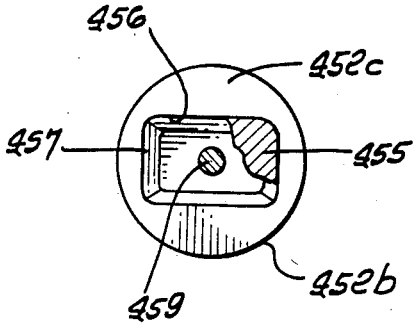
FIG. 20 is a section on lines 20—20 of FIG. 19.

Referring to FIGS. 19 and 20, a ski pole 450 includes sections 451 and 452. Sections 451 includes rod 451a and end portion 451b; and section 452 includes rod 452a and end portion 452b. End portion 451b and 452b have opposed terminals 451c and 452c which are typically engaged when the end portions are assembled together. They define a plane 453 which extends non perpendicularly, i.e. at angle $\Delta$, with respect to the axis 454 defined by the section. That angle is typically between 30° and 60°.

End portion 451b defines a tongue 455 projecting into and interfitting a recess 456 defined by end portion 452b. The tongue and recess have interfitting tapers, as for example are represented at locations 457 and 458, as in the case of the ski section described above. A removable fastener means, such as threaded fastener 459, projects as shown through the tongue and groove, and between end portions 452*b* and 451*b*, to hold the latter together. When it is desired to disassemble the pole sections for transport, fastener 459 is removed, as by inserting a screw driver tip 460 into the side recess 461 in end portion 452*b*, and into the groove 462 in the fastener head, to rotatably back the fastener out of retaining position. FIG. 20 shows the tongue and recess 456 as typically having generally rectangular cross sections.

Figure 21:
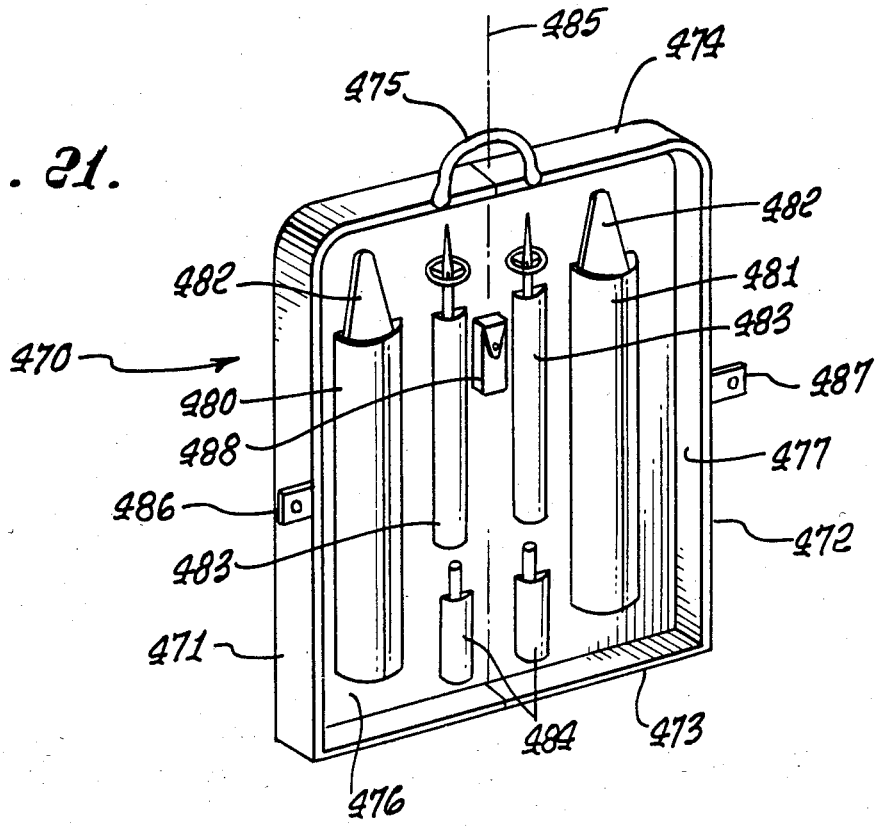
FIG. 21 is an elevation showing a carrying case for the sectioned ski.

Referring to FIG. 21, a ski equipment carrier in the form of a case 470 has side, bottom and top walls 471–474, and a handle 475 for transport. Interior wall 476 is spaced inwardly to form a recess 477 in the case adapted to receive ski equipment. Pockets 480 and 481 on wall 476 have open upper ends to receive disconnected ski sections 482 as referred to above. Pockets 483 receive disconnected pole upper section, and pockets 484 receive pole lower sections. A parts compartment is shown at 488. The case may be closed, as by folding about axis 485, for transport or storage. Retainers 486 and 487 then interconnected to hold the case closed.

Figure 22:
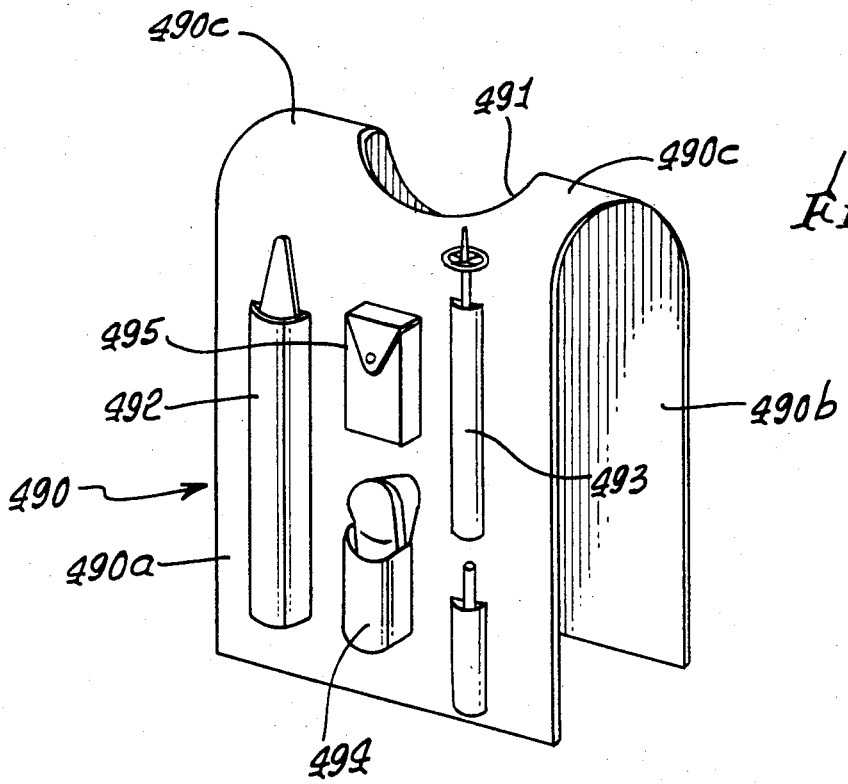
FIG. 22 is an elevation showing a modified carrier for the sectioned ski.

In FIG. 22, the modified carrier 490 forms a pack to be carried by the skier's body, as with front and back panels 490*a* and 490*b*. A neck or head hole 491 passes over the head of the skier, so that pack shoulder portions 490*c* are carried by the skier's shoulder. Thus, the carrier has inverted U-shape. Pockets for ski sections, pole sections and shoes appear at 492–494, on each of the panels, for equally distributing weight. A utility pocket appears at 495.

I claim:

1. In a ski, (a) first and second ski sections having end portions which are interconnectible end-to-end, (b) said first ski section having a recess sunk in said end portion thereof and said second ski section having a tongue projecting from said end protion thereof, said recess and tongue shaped to closely interfit when said ski sections are assembled, end-to-end, thereby forming a full length ski, (c) and means to positively and releasably interconnect said end portions in an assembled condition, (d) said tongue having a wedging interfit with said recess and projecting in an interfit direction generally normal to the plane of the ski top surfaces to be completely enveloped and everywhere concealed and spaced inwardly from all outer surfaces of the ski sections, and including interengaged stopshoulders on the end walls of said end portions said the tongue tapering in the direction of insertion into the recess, (e) said end portions having mutually overlapping-underlapping extents, each end portion having a width which is substantially the same as the full width of the ski and continuing substantially throughout the length of said overlapping-underlapping extents, the end portion of said first ski section having a planar surface surrounding said recess which engages a corresponding surface at the base of the tongue on the end portion of said second ski section, said sections further having pairs of adjacent shoulders proximate opposite ends of said planar surface and extending outwardly therefrom towards the outer surfaces of the ski sections, (f) said means to interconnect said ski section end portions including fastener elements extending from said one ski section end portion into a terminal end portion of the tongue when fully inserted into said recess, and confined between upper and lower planes defined by the outer surfaces of the two ski sections, and (g) said tongue having an overall length dimension in the direction of the ski length which is substantially greater than the of said section overall thickness.

2. The ski of claim 1 wherein said end portions define a plane of engagement which is generally parallel to the plane of the ski top surface.

3. The ski of claim 1 wherein said end portions define a plane of engagement which is tilted relative to the plane of the ski top surface.

4. The ski of claim 1 including additional tongue and groove interfitting elements on the end walls of said end portions.

* * * * *